United States Patent [19]

Czeschka et al.

[11] Patent Number: 4,579,412

[45] Date of Patent: Apr. 1, 1986

[54] CODED TRANSFER PLUG SYSTEM

[75] Inventors: Franz Czeschka, Rechberghausen; Rudi Singer, Wäschenbeuren, both of Fed. Rep. of Germany

[73] Assignee: ERNI Elektroapparate GmbH, Fed. Rep. of Germany

[21] Appl. No.: 610,388

[22] Filed: May 15, 1984

[30] Foreign Application Priority Data

May 18, 1983 [DE] Fed. Rep. of Germany ..... 3318137

[51] Int. Cl.[4] ..... H01R 13/627; H01R 13/645

[52] U.S. Cl. ..... 339/91 R; 339/186 M

[58] Field of Search ..... 339/184 R, 184 M, 186 R, 339/186 M, 91 R

[56] References Cited

U.S. PATENT DOCUMENTS

| | | | |
|---|---|---|---|
| 3,065,447 | 11/1962 | Maurer | 339/184 M |
| 3,434,098 | 3/1969 | Schumacher | 339/184 M |

FOREIGN PATENT DOCUMENTS

| | | |
|---|---|---|
| 36770 | 9/1981 | European Pat. Off. . |
| 1490737 | 5/1970 | France . |
| 1959885 | 6/1971 | France . |
| 2021547 | 11/1971 | France . |
| 7703063 | 2/1977 | France . |
| 2534775 | 2/1977 | France . |
| 2075281 | 11/1981 | United Kingdom . |

*Primary Examiner*—John McQuade

*Attorney, Agent, or Firm*—Toren, McGeady, Stanger, Goldberg & Kiel

[57] ABSTRACT

A transfer plug system for electrical or electronic controls or devices having coding parts which correspond to one another mechanically and are attached at a cable housing as well as in the area of a counter-plug element, the coding parts being brought into engagement with one another and held by means of a shared locking element, the locking element thus operating to fulfill a dual function of coding for preventing faulty plugging and of fastening and locking the plug housing at plates or in a structural component part carrier.

3 Claims, 4 Drawing Figures

CODED TRANSFER PLUG SYSTEM

The present invention is directed to a transfer plug connector system particularly for electrical or electronic controls or devices such as the cable housing of a multiple plug a so-called "motherboard" and/or a printed circuit board.

Systems or plug structureal components or this type are known, e.g., from DP-PS No. 19 59 885 and are intended for inserting or plugging into a structural component carrier, wherein the plug structural component is to be locked in the structural component carrier and has a printed circuit board having electronic structural component elements and carrying at least one plug part on its front or rear side into which a counter-plug is to be inserted. In the interest of secure operation of such an electronic arrangement, all plug structural components plugged into a structural component carrier are to be fixed or locked in place in such a way that they do not unintentionally slip out of their holder and lose electrical contact.

With regard to additional prior art and other complex problems which may arise, reference is here made to the introductory part of the specification of DE-PS No. 19 59 885, mentioned above.

Another requirement in this type of structural component carrier consists in preventing absolutely faulty plugging of the cable housings.

In this respect it has been known until the present time to execute a corresponding coding at the respective plug itself. However, it has been shown repeatedly in practice that with rigorous behavior or rough handling this coding does not provide secure protection against faulty plugging by means of the relatively thin plug pins and electrical contact of structural component parts not determined for one another can occur at least briefly, possibly damaging the entire arrangement. Other known coding methods have similar disadvantages.

Therefore, it is the object of the present invention to reliably eliminate these disadvantages and, in addition to providing a good and reliable locking of the cable housings, to prevent faulty plugging of the latter from the outset.

This object is met by means of the structural particularities and steps, and the particularities and steps pertaining to the apparatus and arrangement, indicated hereinafter, wherein the overriding inventive idea and technical teaching is to be seen substantially in that one and the same structural component part and one and the same mechanical step simulteneously fulfills the function of locking, as well as that of coding the cable housings to be attached. Thus, the inventive advantage, aside from the increased reliability, consists in the structural simplicity as a whole.

SUMMARY OF THE INVENTION

Briefly, the present invention may be described as a transfer plug system for electronic control devices such as the cable housing of a multiple plug, a so-called "motherboard" or a printed circuit board operating as a support for individual plug connectors or their structural components as well as fastening means for locking structural component parts comprising a counterplug with a holder and coding parts which mechanically correspond to each other provided at said housing as well as in the area of said holder of the counterplug, said parts being guided so as to be fixedly locking, coded and held by means of at least one locking element.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
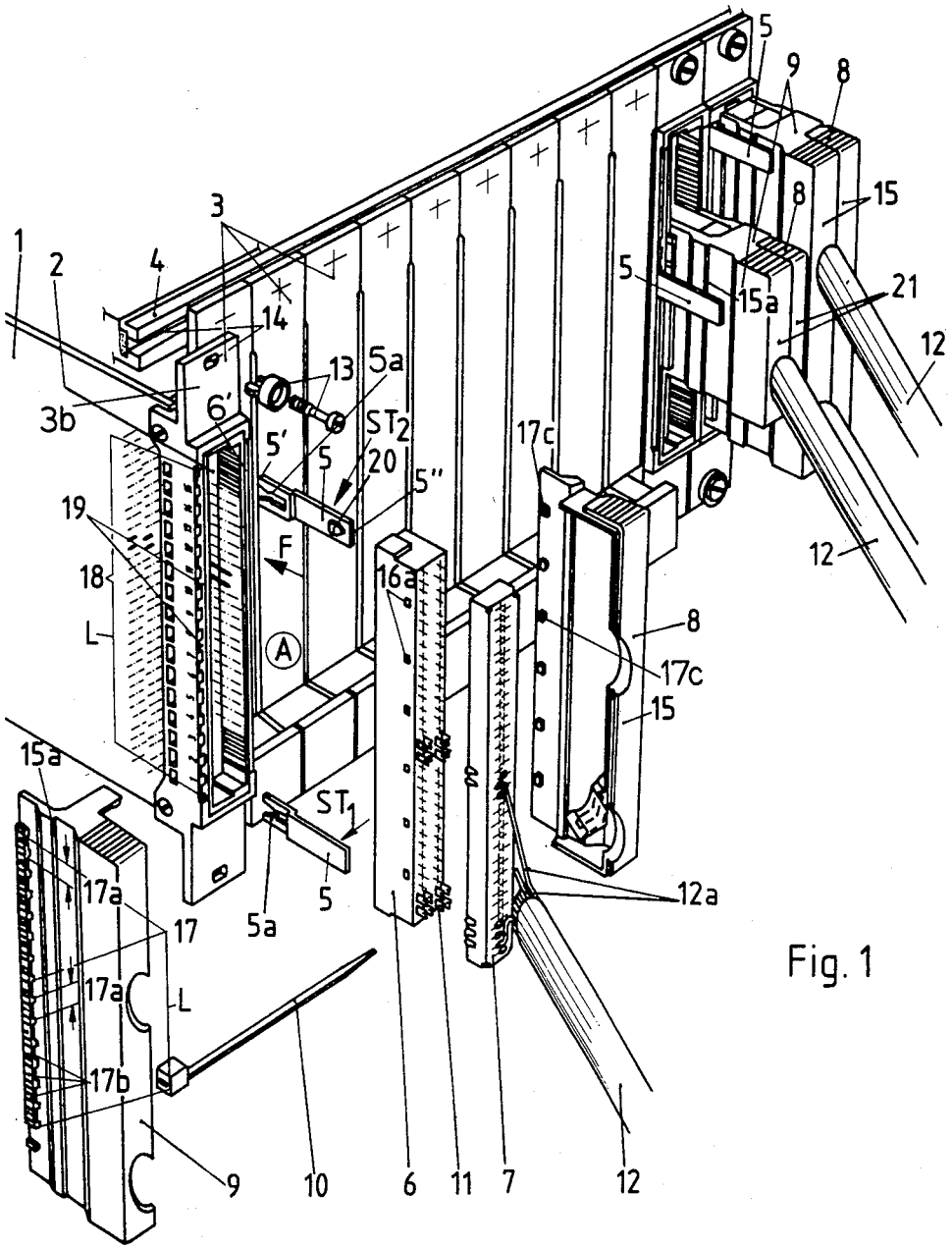
FIG. 1 is an exploded perspective view of a transfer plug system in accordance with the invention.
Figure 2:
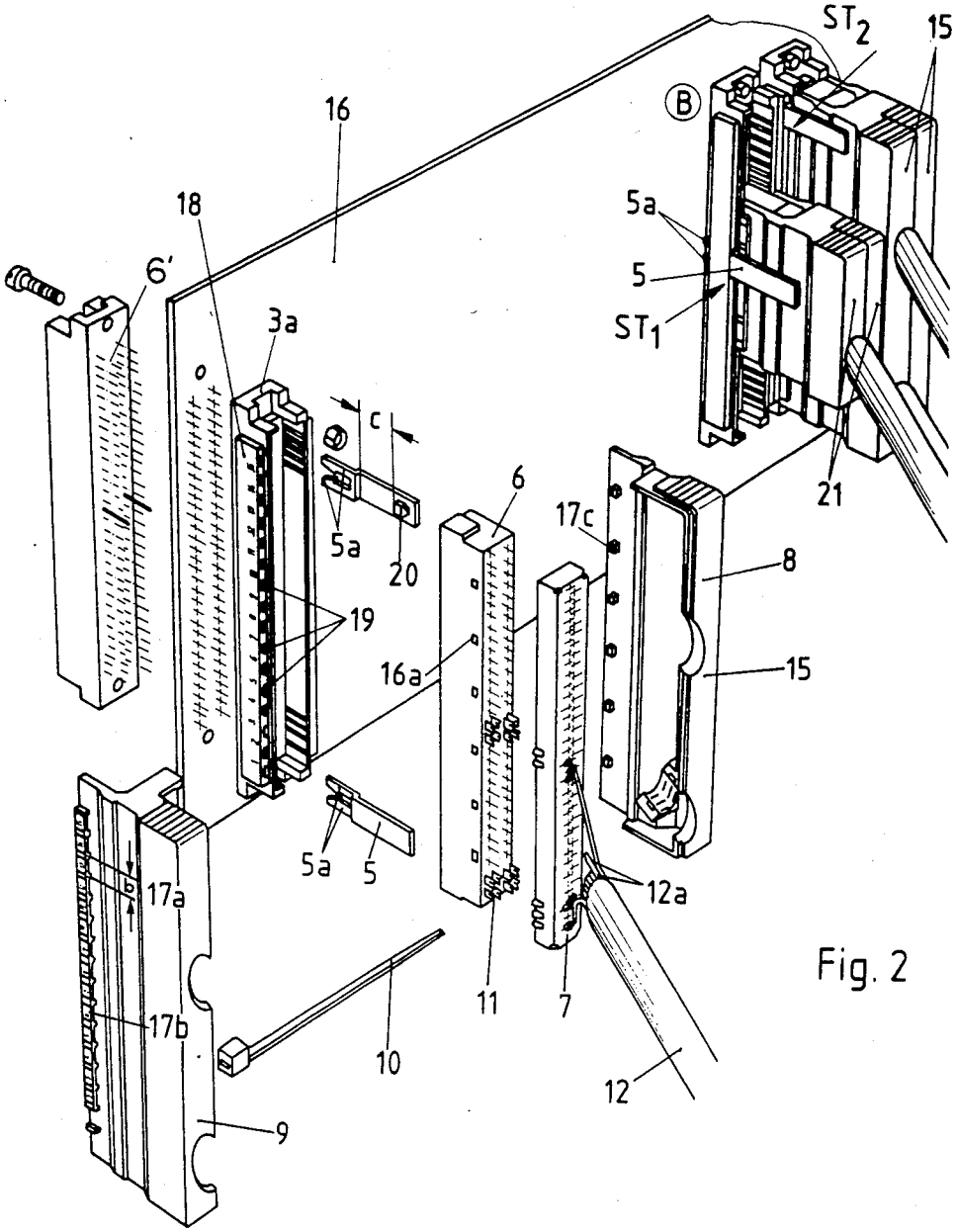
FIG. 2 is an exploded perspective view of an alternative embodiment of the invention.
Figure 3:
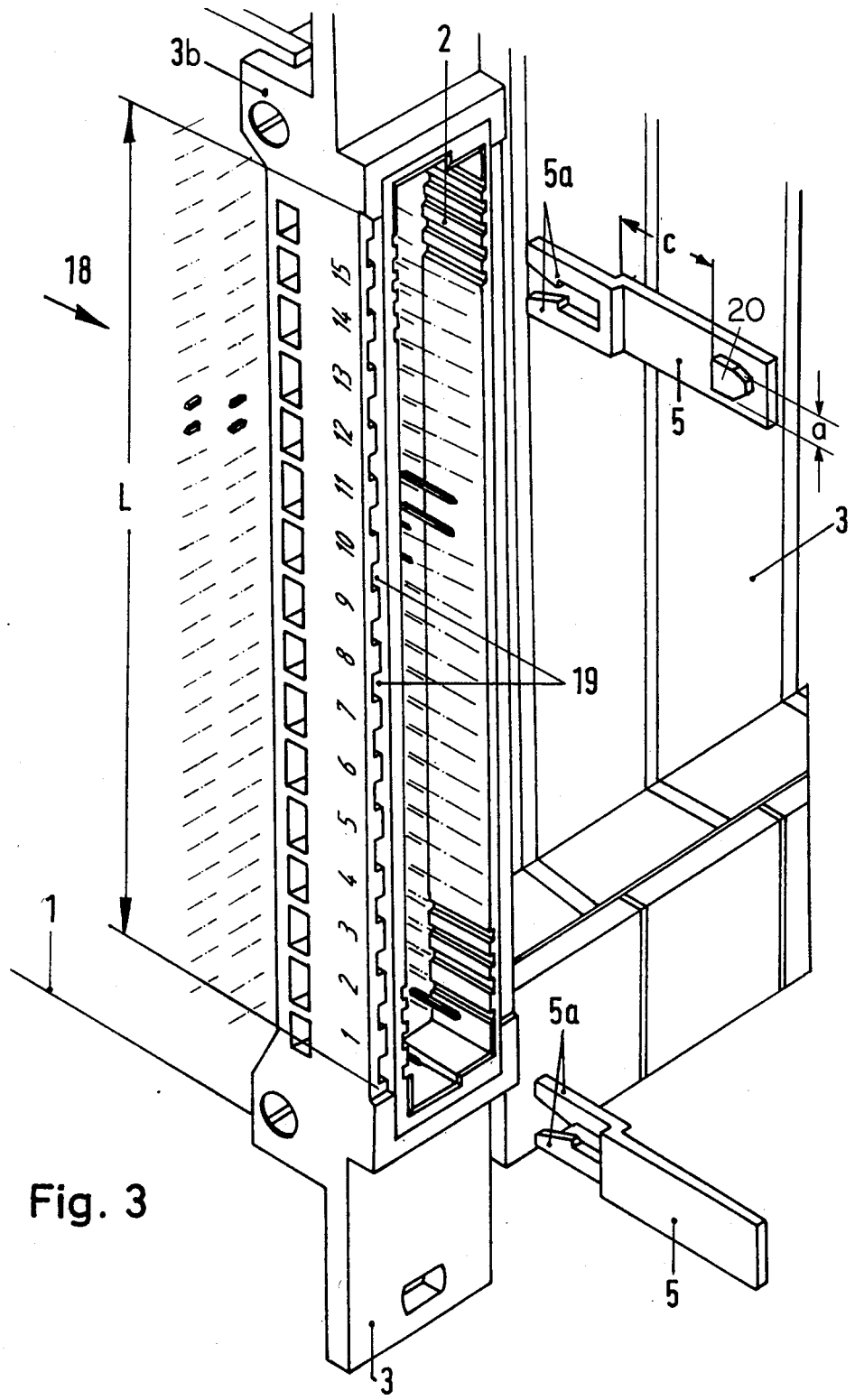
FIG. 3 is a perspective view showing in greater detail a portion of the assembly identified with a circled A in FIG. 1 shown on an enlarged scale.
Figure 4:
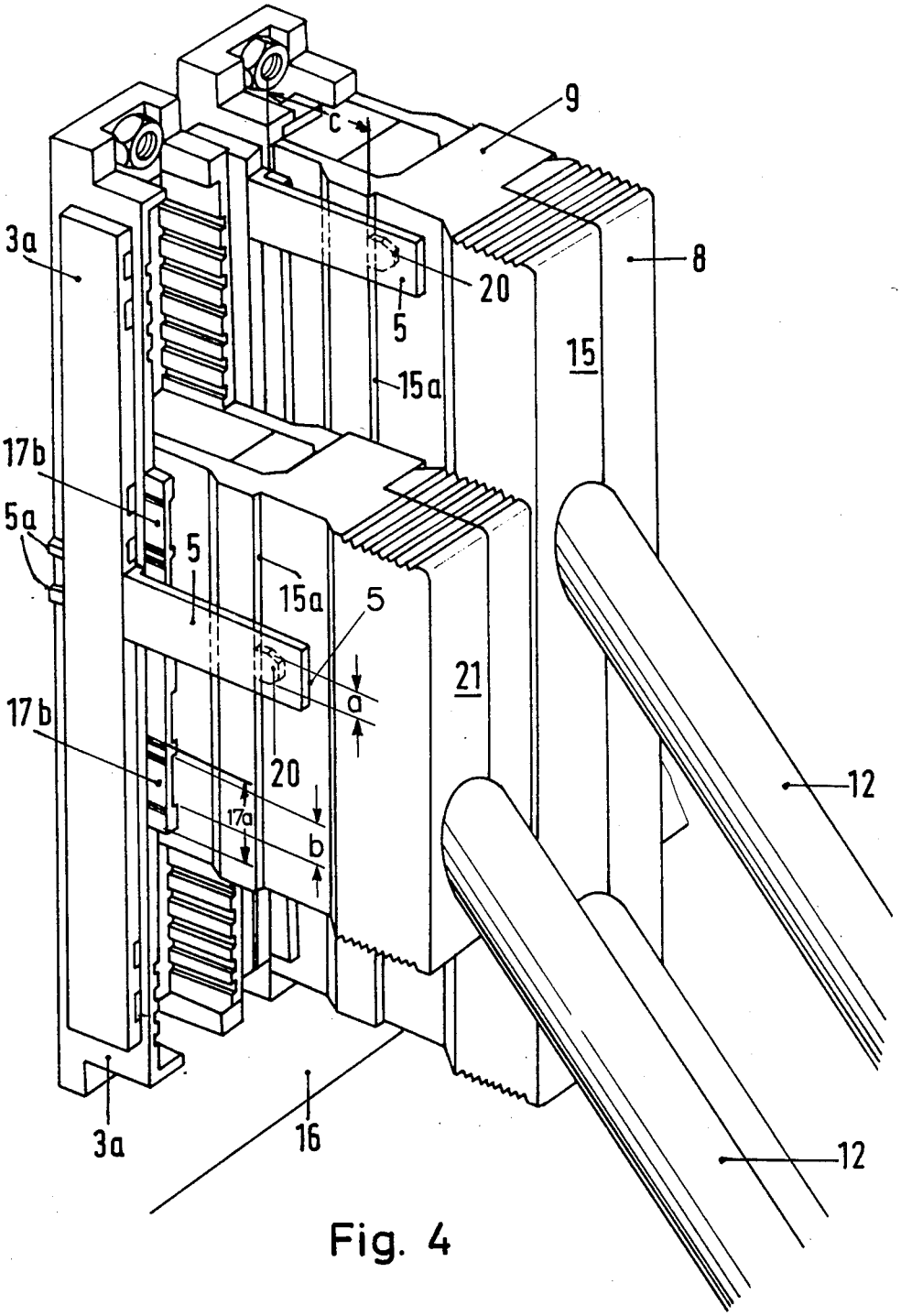
FIG. 4 is a perspective view showing in greater detail a portion identified with a circled B in FIG. 2 and also shown in greater detail.

Referring now to the drawings, the basic construction of the coded transfer plug system, according to the invention is shown in FIG. 1 and also in FIG. 2 in an analogous manner based on the basic principles of the invention which among its known structural component parts includes a printed circuit 1 with a modular multiple plug 2 in the form of a guide frame **3*b* for so-called front plugging, fastened at a so-called "motherboard" 4 by means of the screw connections 13, 14 indicated in the exploded view. Also indicated in the exploded view in the left half of the drawing as plug elements corresponding to the above are the female multiple or multipoint plug housing 6, tipped with known blade or cutting edge clamp contacts 11 and the two half shells 8 and 9 which form the actual cable housing 15 when assembled with the cable guide part 7, as shown in the upper right half of this figure. Also important, but of secondary significance for the present invention, are the catches or rests 16*a* fixing or fastening the assembled connector, as well as cams 17*c* the female multiple plug housing 6 and the cable guide part 7, which ultimately serves to distribute the individual cable lines or cords 12*a* branching out of the round cable 12. Reference numeral 10 shows the cable binder likewise known. Note that numeral 3 in FIG. 1** merely shows covering elements which may be removed for the insertion of further guide frames.

In this embodiment and in the alternative embodiment of FIG. 2 which is only distinguished from the former in that the guide frame **3*a* is fastened directly on a corresponding printed circuit board 16, it is provided in general, according to the invention, that coded parts or strips 17, 18 or the like, which correspond with one another mechanically, are attached at the cable housing 15 as well as in the area of the holder 3*b* and 3*a*, respectively, of the counter-plug element 6' and these parts 17, 18 are guided, coded and held by means of at least one locking element 5** in a fixed locking manner.

A special and structurally simple construction is achieved by means of pockets **17*a*, or similar parts, formed on at both sides of the cable housing 15 and comprising breakaway or otherwise removable web parts 17***b*, as well as plug bushes or sleeves 19 or the like which are arranged in the area of the counter-plug elements 6' at the same alignment F and serve for receiving hook portions 5*a* of the end parts 5' of the locking elements 5, which hook portions 5*a* are split in the manner of a clamp or clasp. A special structural feature of the invention comprises a cam 20, or like projection, facing toward the cable housing 15 provided on the free end 5'' of each locking element 5, which free end 5'' is located opposite the hook portion 5*a*. The width a of the cam 20 corresponds to the inner dimensioning b of the pockets 17*a* arranged at the cable housing 15 and the distance c of the cam 20 from the plug arrangement surface or from the housing guide frame 3*a*, respectively, is dimensioned in such a way that the respective cam 20 engages behind a corresponding housing step or shoulder or a corresponding gradation 15*a* in the locked state, as seen in upper right part in FIG. 2.

Significantly in this respect and for the purpose of providing a plurality of coding possibilities there is, in addition, a strip or row L of a plurality of pockets 17*a* and plug-in bushes 18 corresponding to the latter at both sides of the cable housing 15 and contact plate 16 or housing guide frame 3*a* or *b*, wherein the respective strips 17 and 18, which serve the dual function of mechanical coding and locking, are formed on (FIG. 2) or put on the sides of the cable housing 15 and guide frame 3 so as to be raised or are structurally integrated in the latter.

Thus, such a transfer plug system is distinguished in that in order to code the individual cable housings 15 and 21 in this transfer plug system, the locking elements 5 are arranged, preferably on both sides, at different places $ST_1$ and $ST_2$, wherein this is achieved by means of breaking away or similarly moving the web parts 17*b* arranged there and faulty plugging of differently constructed cable housings 15 and 21 is also accordingly prevented in a secure and simple manner.

While specific embodiments of the invention have been known and described in detail to illustrate the application of the inventive principles, it will be understood that the invention may be embodied otherwise without departing from such principles.

What is claimed is:

1. A transfer plug system for a two-part coupling of electrical or electronic controls or devices, comprising:

a guidance frame having a male multiplug connector equipped at least on one side side with recesses for receiving of coding pins;

a cable housing with a female multipoint connector inside of said cable housing, said cable housing having two half-shell outer portions surrounding said female multipoint connector;

coding connections being located on at least one outer side of the cable housing, said coding connections having breakaway bars which, after their removal, display openings; and coding pins, said coding pins having a clamp-shaped latch at one end and a cam at the other end, said coding pins being seated with one end in the recesses of the guidance frame of the male multipoint connector by means of said clamp-shaped latch and said cam which, after the connection of said coding pin is completed, engages behind a shoulder located on the outer side of one of the cable housing half-shell portions, said coding pins for providing a coding arrangement to prevent improper electrical coupling and for providing a latch arrangement to prevent disconnection of coupled devices.

2. A transfer plug system according to claim 1, wherein the width of the cam corresponds to the inside dimension of the breakaway parts of the coding connections.

3. A transfer plug system according to claim 1 or 2, wherein the coding connections and the shoulders coact with the cams of the coding pins, which coding connections are raised over the cable housing half-shells and are molded onto these half-shells.

* * * * *